US007114874B2

(12) United States Patent
Burns et al.

(10) Patent No.: US 7,114,874 B2
(45) Date of Patent: Oct. 3, 2006

(54) SECURITY BARRIER

(76) Inventors: Robert Burns, 808 Dowling Way, The Villages, FL (US) 32162; Dennis Darling, 16005 5th St. East, Redington Beach, FL (US) 33708; Paul Hurlburt, 2 Arbor Crossing, Kennebunk, ME (US) 04043; Gary Ketner, 17323 146th Pl. NE., Woodinville, WA (US) 98072

( * ) Notice: Subject to any disclaimer, the term of this patent is extended or adjusted under 35 U.S.C. 154(b) by 0 days.

(21) Appl. No.: 11/100,673

(22) Filed: Apr. 6, 2005

(65) Prior Publication Data

US 2006/0078378 A1 Apr. 13, 2006

Related U.S. Application Data

(63) Continuation-in-part of application No. 10/832,654, filed on Apr. 27, 2004.

(51) Int. Cl.
*E01F 13/00* (2006.01)

(52) U.S. Cl. ..... 404/6; 49/49; 49/131

(58) Field of Classification Search ..... 404/6; 256/13.1

See application file for complete search history.

(56) References Cited

U.S. PATENT DOCUMENTS

| | | | | |
|---|---|---|---|---|
| 4,490,068 A | | 12/1984 | Dickinson | |
| 4,572,080 A | | 2/1986 | Williams et al. | |
| 4,576,508 A | | 3/1986 | Dickinson | |
| 4,824,282 A | * | 4/1989 | Waldecker | 404/6 |
| 4,934,097 A | | 6/1990 | Quante | |
| 5,639,178 A | | 6/1997 | Wilson et al. | |
| 5,829,912 A | * | 11/1998 | Marcotullio et al. | 404/6 |
| 5,993,104 A | * | 11/1999 | Marcotullio et al. | 404/6 |
| 6,312,188 B1 | * | 11/2001 | Ousterhout et al. | 404/6 |
| 6,527,475 B1 | * | 3/2003 | Lowrie | 404/6 |
| 6,896,443 B1 | * | 5/2005 | Ousterhout et al. | 404/6 |
| 2005/0238424 A1 | * | 10/2005 | Burns et al. | 404/6 |

* cited by examiner

*Primary Examiner*—Gary S. Hartmann
(74) *Attorney, Agent, or Firm*—David McEwing

(57) ABSTRACT

An apparatus and method for providing a portable, rapid deployable barrier system which utilizes autonomous operation and one or more gas generators to rapidly activate the barrier. The invention includes a barrier component installed beneath the ground surface or substantially parallel to the ground and raised by activation of the gas generator. The device can be trigger automatically without human intervention and thereby faster deployment of the barrier. The invention permits the passage of pedestrians, vehicles, etc. or activation into a barrier position.

8 Claims, 8 Drawing Sheets

SECURITY BARRIER

RELATED APPLICATION

This application is a continuation in part of application Ser. No. 10/832,654 entitled Security Barrier and filed Apr. 27, 2004.

BACKGROUND OF INVENTION

1. Field of Use

The invention pertains to a portable, easily and removeably installed, high strength impact resistant and rapidly deployable security barrier for the protection of persons and property from objects such as trucks and cars traveling at ground surface level.

2. Prior Art

Vehicle and traffic barricades are well known and are in wide use for building and personnel security applications. These systems can be permanent or temporary. The barricades can be stationary or mobile with relatively rapid deployment for raising/lowering. The barricades can be wall like sections providing a resistive mass of reinforced concrete or hollow resinous plastic structures filled with water. Other types of traffic or vehicle control barriers are bollards that are fixed in position or that can be raised and lowered from the ground surface level.

Bollards have been shown to be capable of incapacitating or stopping vehicles up to 7.5 tons GVW moving at speeds of 50 mph. The current raisable bollard systems have deficiencies that have been demonstrated based on current world events and terrorism threats. These deficiencies are related to their dependency on human interaction to deploy the barrier of the bollard system, they are slow to activate, provide inadequate capabilities to prevent intrusion, and they are dependent on electric power or air systems which can be compromised by threats. The mechanism used to power the raising and lowering can be springs, hydraulics, motors or gas cylinders. However, existing bollards or barriers that are raised to selectively block or control vehicle movement require either human intervention that retards deployment time, thereby diminishing effectiveness, or do not have sufficient mass to effectively block a large or heavy vehicle. Other bollard/barrier devices require installation beneath the ground surface level and separately powered control and motor mechanisms to raise (deploy) the barrier.

There is accordingly a need for a portable, rapidly deployable barrier system having sufficient capability to provide an effective barrier to heavy motor vehicles. There is also a need for a non-obtrusive barrier protective system than can be easily and quickly installed and removed.

SUMMARY OF INVENTION

The invention pertains to a method and apparatus for deploying protective barriers/bollards utilizing a gas generation system (gas generator) to power the rapid raising of the barrier structure to block the passage of a vehicle. The gas generator can be activated by a variety of means and independent of human intervention. The energy supplied by the gas generator allows deployment of the barrier from a stored to protective position at a speed significantly greater than achieved by existing methods. This allows the activation device to be placed close to the barrier, thereby permitting use of an automated barrier protective system in relatively confined spaces with minimized instances of unintended or unnecessary activation.

The gas generator power source also permits a variety of mechanical mechanisms and configurations for raising the barrier from a stored to protective or deployed position. The barrier can be raised in a relatively straight direction substantially normal to the plane of the ground surface. The barrier can also be raised from a stored position relatively parallel to the plane of the ground surface to a position normal to the plane. The barrier can also be elevated from a stored position relatively parallel to the plane of the ground surface level to an angled position whereby the force of impact is directed into the ground, thereby causing the ground to absorb a significant portion of the load. The deployed angle of the barrier can be combined with the support structure designed to facilitate the transfer of load to the ground.

The activation of the barrier component of the barrier system can be achieved by a variety of means. One method would be activation occurring in response to the wheels of a motor vehicle passing over a pressure sensitive triggering mechanism. It will be readily appreciated that the pressure sensitivity can be adjusted to distinguish between a motor vehicle and a pedestrian.

The activation of the barrier system may also be a motion detector, or a magnetic, strain, chemical, infra-red or radiation sensor. A remote sensor can signal activation by RF or similar signal, requiring little power. The sensor and signal power source may be batteries or similar independent means, thereby minimizing deactivation of the protective system by power failure or sabotage.

The deployed barrier can also include a reactive component such as a gas generator powered air bag or separate explosive charge such as a directionally oriented shaped charge.

It is therefore an object of the invention to provide a rapidly deployable barrier.

It is another object of the invention to provide a barrier system that has a minimal visual impact to the protected structure or for protective surveillance.

It is a further object of the invention to provide a barrier that can be activated without human intervention.

It is another object of the invention to provide a barrier that can be quickly installed and removed It is another object of the invention that the protective barrier can be portable and installed with minimal site preparation.

It is another object of the invention is a protective barrier system without preparation or intrusion beneath the ground surface level.

It is also an object of the invention to provide a protective system that is operational/activation energy self-contained.

Other benefits of the invention will also become apparent to those skilled in the art and such advantages and benefits are included within the scope of this invention.

SUMMARY OF DRAWINGS

The accompanying drawings, which are incorporated in and constitute a part of the specification, illustrate preferred embodiments of the invention. These drawings, together with the general description of the invention given above and the detailed description of the preferred embodiments given below, serve to explain the principles of the invention.

DETAILED DESCRIPTION OF INVENTION

Figure 1:
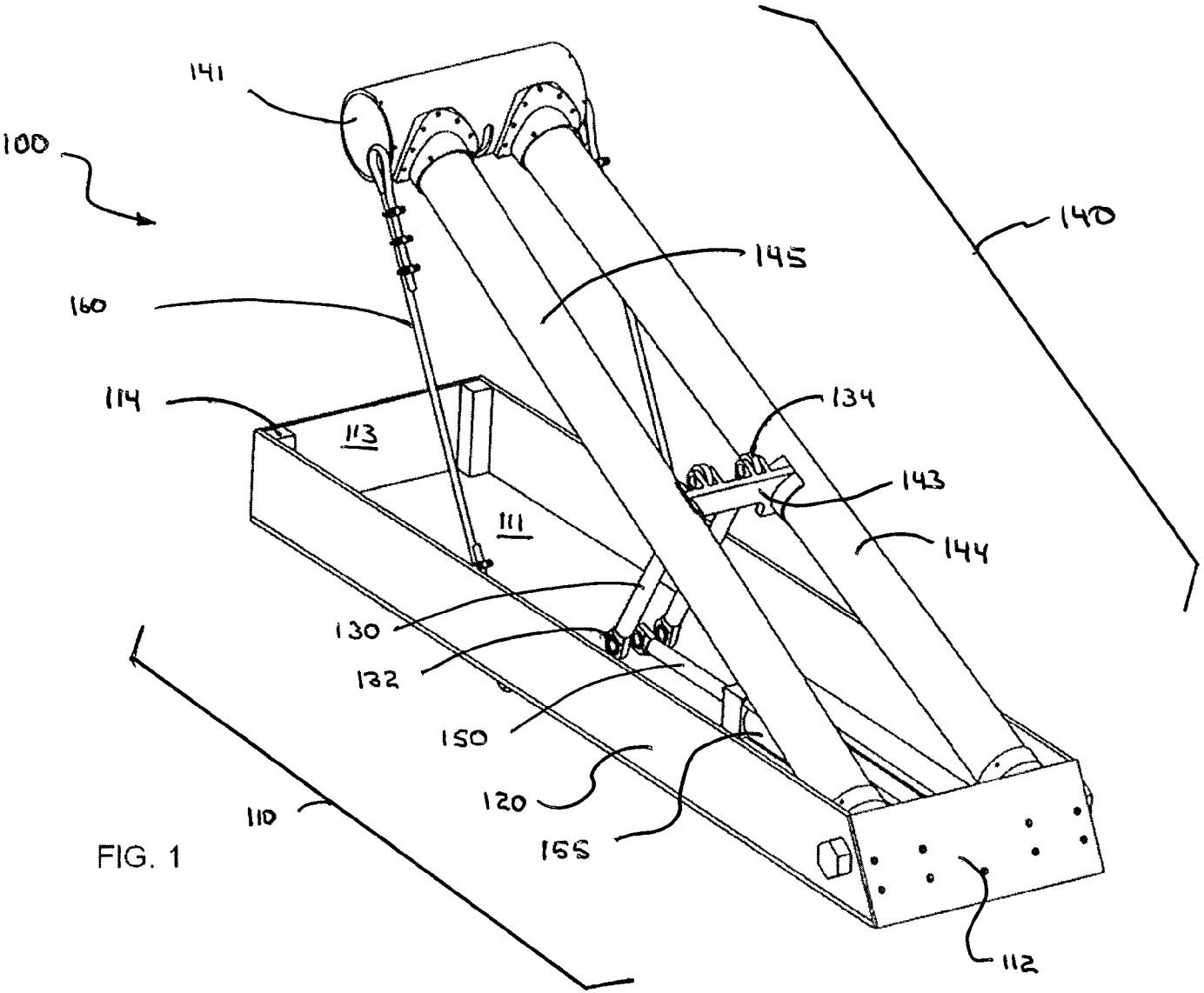
FIG. 1 is a perspective view of the preferred embodiment of the invention comprising a housing, a cylinder and piston component containing a gas generator, a hinged barrier component, a pivotable attached swing arm to deploy the barrier in response to movement of the piston within the cylinder, and tethers to control the upward movement and deployed height of the hinged barrier.

The invention subject of this disclosure is a further embodiment of the invention subject of application Ser. No. 10/832,654 entitled Security Barrier, filed Apr. 27, 2004 and which is incorporated by reference herein and may be referenced herein as the "parent application".

The above general description and the following detailed description are merely illustrative of the subject invention and additional modes, advantages and particulars of this invention will be readily suggested to those skilled in the art without departing from the spirit and scope of the invention. The requirements for the barrier system will vary based on the intended application. These variations are related to the denial requirements, the type of installation (permanent or temporary), location of the system, and the type of asset to be protected.

The invention proposed consists of an autonomous or automatic barrier or barrier restraint system, including automatic trigger sensors, communication devices to deploy the barrier component of the systems, automatic sensors to detect or activate the system, and an independent, self contained power supply to provide monitoring, activation, or alarm.

Deployment of the barrier component, regardless of the specific configuration of the barrier system, e.g., bollard, gate or wall-like sectional barrier, will be carried out by a gas generator. The gas generator will be integral to the system and be capable of deploying a barrier which is capable of stopping a 15000 lb gross vehicle weight (GVW) vehicle and which deploys the barrier in 150 milli-seconds or less. This is nominally 10 times faster deployment than the fastest barrier currently available and the proposed system does not depend on any human interaction which requires significant additional time. What this means is that a vehicle moving at 50 mph will travel 110 ft in 1.5 seconds. Add to the conventional system the time required for personnel to activate it and this would require detection of the threat and activation of the restraint system nominally 100's of feet before the vehicle reaches the barrier. The proposed invention will permit 11 feet or less of travel at 50 mph from the time the barrier is activated until the vehicle is stopped by the deployed barrier.

The gas generator will be integral to the restraint device. The gas generator will contain solid propellant that, upon ignition and combustion, creates heated gas that rapidly expands within a cylinder. Mechanisms within the cylinder are powered by the gas to raise the barrier component into its deployed position. A mechanical mechanism may lock the restraint device into a deployed position. The propellant is ignited by a device termed a squib or igniter. The squib receives a signal from the integral power supply. This signal may be activated manually or automatically depending on selection of how the restraint system is configured. The receipt of the signal to activate the squibs may be hard wired or received via a wireless mode including but not limited to radio frequency (RF), microwave, satellite, cellular telephone or Bluetooth® signals. (Bluetooth is a registered trademark of Bluetooth SIG Inc.) The signal can be encrypted as necessary for security reasons. The signal can also be sent by detectors that can detect motion, magnetic or electromagnetic field, radiation, mass, chemicals or explosives.

The barrier system is comprised of several components. The system is comprised of the deployable barrier and a gas generator. The components of the embodiment particularly described in this disclosure may include a housing, a barrier, a gas generator, a piston, a locking mechanism, an activation system, and a swing arm. The components may be stored and transported within a housing component which, when installed, may form part of the barrier system structure.

Alternatively, some components may be separately stored and assembled together at the installation site. In a further embodiment of the invention, the components may be disassembled and relocated to a separate installation site as needed.

The barrier component may include a separate gas generator powered air bag or directed gas stream. The barrier may include another type explosive charge. The explosive charge may be a shaped charge. A barrier of the type described in this paragraph will be referred to as a reactive barrier.

The barrier component is elevated from the stored position to the deployed position by movement of the swing arm. The swing arm is powered by energy from the gas generator. The explosive force of the rapidly expanding gas from the gas generator may push a piston within a cylinder and extend the piston rod attached to one end of the swing arm. The gas generator is preferably located within the cylinder. It will be appreciated that there may be alternate configurations to the cylinder, piston and piston rod assembly. For example, the components may comprise two or more cylinders, each having a closed end and open end, as disclosed in the parent application. See for example FIG. 1 of the parent application and the accompanying description.

It will be appreciated that the swing arm component described herein occupies substantially the same position as the barrier component (also called stability component) of the parent application. See for example the stability component, item 290, illustrated in FIG. 4 of the parent application.

Turning to the drawings of this disclosure, FIG. 1 illustrates the components of an embodiment of the invention in a deployed position. (When stored, the components lie flat within the housing.) The barrier system 100 consists of a housing component 110, one or more housing support beams 120, a barrier swing arm 130 having a first end 132 and a second end 134, a barrier structure 140 pivotably attached to a back end 112 of the housing or housing/cylinder connector (not shown), a gas generator comprising a solid and ignitable propellant, a piston rod 150 and cylinder 155, an igniter, a control system tether/support 160 to control the height of the barrier 140 deployment and support the impacting structural members and an optional anchoring system. The barrier component 140 may include a subcomponent 141. This subcomponent may include an explosive charge or other active device, thereby constituting a reactive barrier.

All of the system components may be stored and carried within the housing 110 component prior to installation. It will be appreciated that the barrier 140 illustrated in FIG. 2 can lie flat within the housing 110 illustrated in FIG. 3. The housing may have an elongated rectangular shape with a substantially flat bottom surface 111 that can be laid on a similarly substantially flat surface such as the ground or a roadway (not shown). The housing may have the dimensions L×H×W as shown in FIGS. 4A and 4B. The elongated housing sides 120, (longitudinal sides) comprise the support beams and provide structural support for the system when the barrier 140 is deployed to an angled position relative to the ground surface. The barrier component is also illustrated in FIG. 2.

When stored or prior to deployment by activation of the gas generator, the swing arm 130, support beam 120, piston rod 150 and cylinder 155 are substantially co-planer to the bottom 111 of the housing component 110. Stated alternately, prior to deployment, the length of each component is oriented substantially parallel to the ground surface. The components may fit within the space defined by the housing component. This flat and compressed array facilitates storing and transport of the invention to the installation site.

Figure 2:
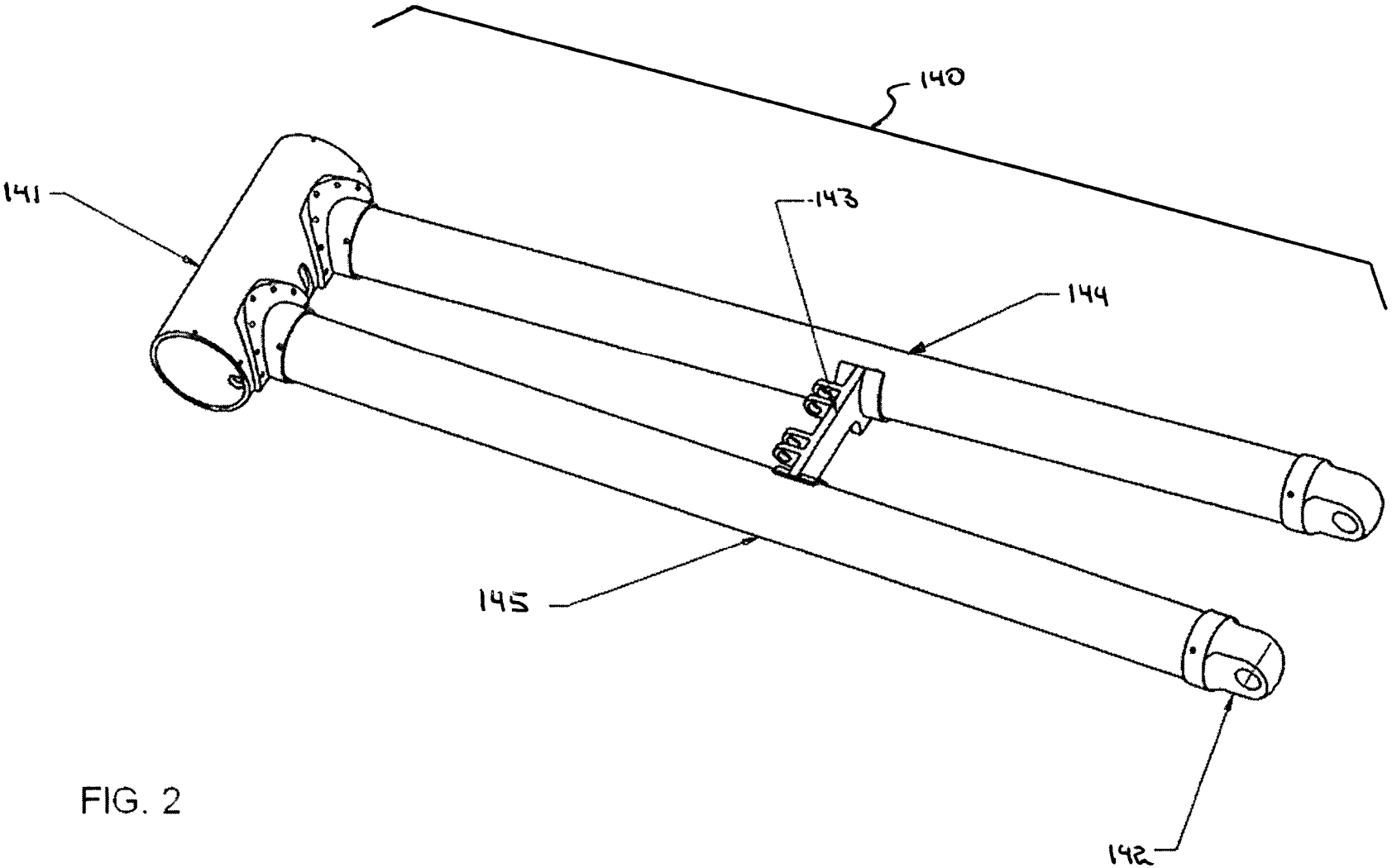
FIG. 2 illustrates the preferred embodiment of the barrier component including tubular load transfer arms, swing arm hinge attachment subcomponent and housing hinge attachment subcomponents.
Figure 3:
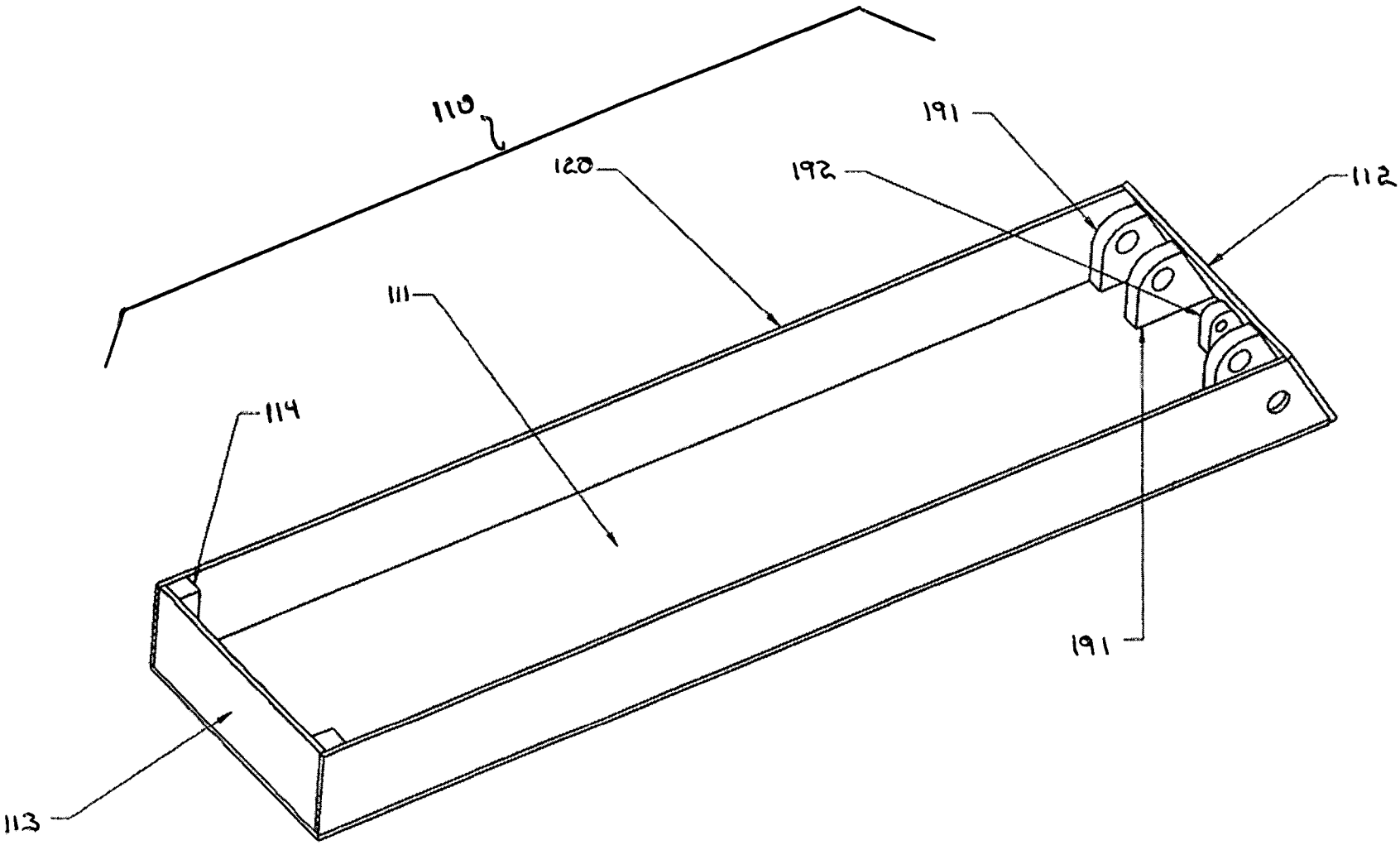
FIG. 3 illustrates a perspective view of the preferred embodiment of the housing component including the support beam/side wall component, bottom plate, angled back end plate, and the barrier hinge attachment subcomponent and gas generator cylinder attachment component.
Figures 4A, 4B:
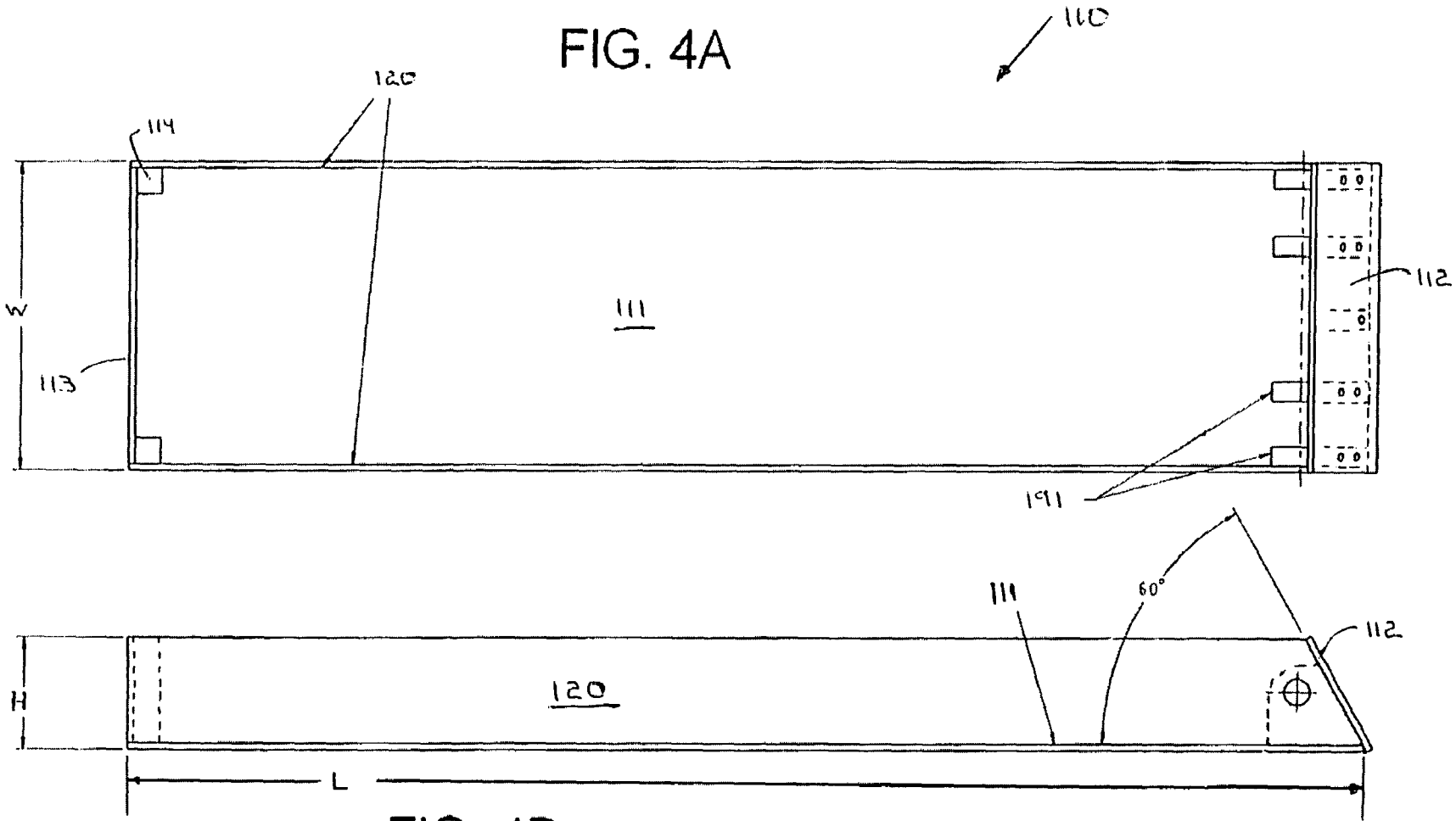
FIG. 4A illustrates a top view of the housing component including barrier hinge attachment subcomponents, support beams and angled housing back plate.
FIG. 4B illustrates a side view showing the support beam/side wall and angled back end of the housing.
Figure 5:
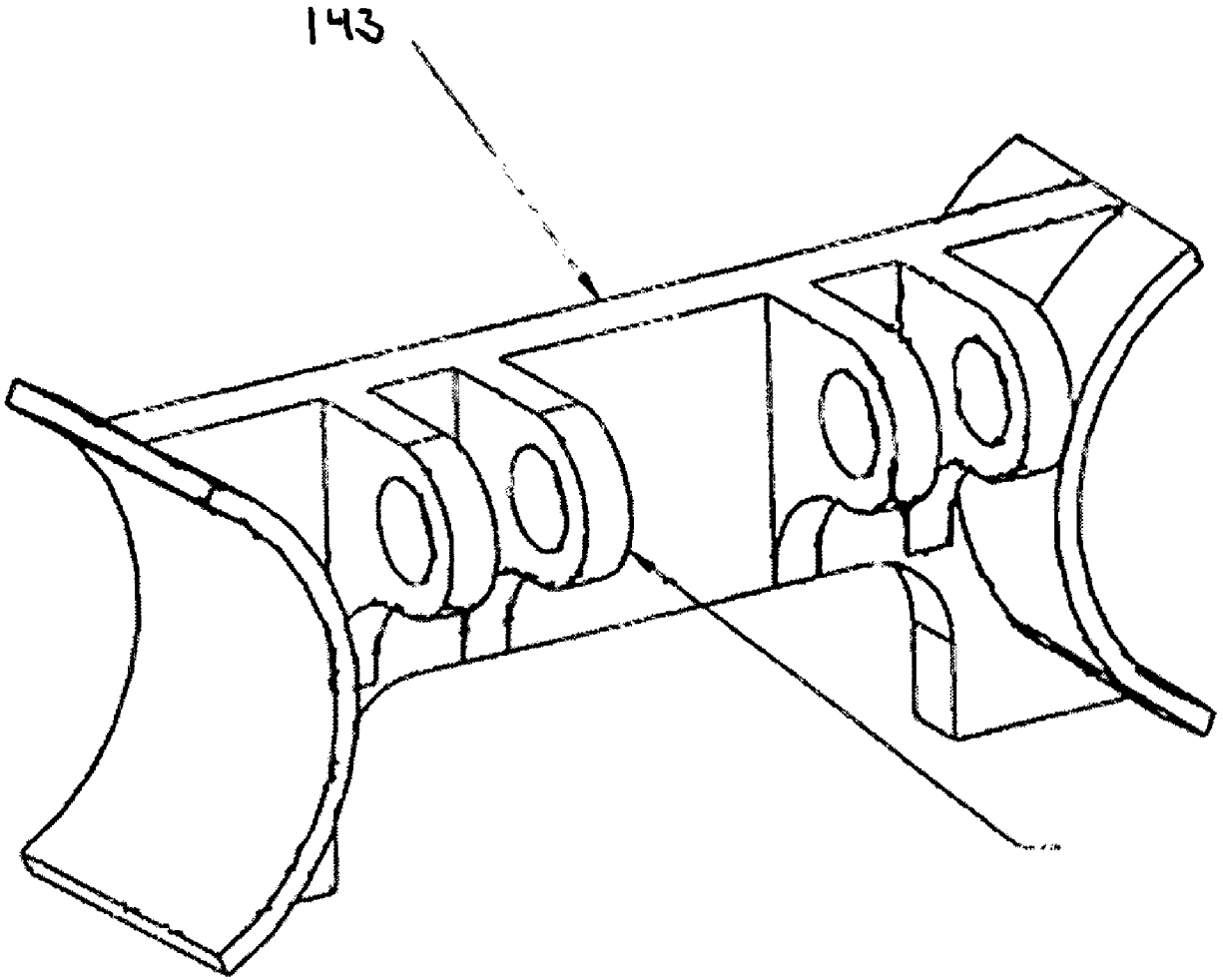
FIG. 5 is a perspective view of the swing arm hinge attachment subcomponent used to connect the swing arm to the barrier component and providing reinforcement to the tubular load transfer arms.

Referring to FIGS. 2 & 3, some of the components are also attached to the housing 110. The support beams 120 form the side of the housing. The barrier structure 140 comprises a first barrier end 141 and a second barrier end 142. In the preferred embodiment, the second end 142 is hingeably or pivotably attached 191 to the back end 112 of the housing 110. The second end of the barrier may alternatively be hingeably attached to the cylinder or a component 192 connecting the cylinder end (not shown) to the housing. One end of each tether (not shown) is also attached to the housing. The barrier component 140 also includes a swing arm hinge connector attachment 143. It will be appreciated that the preferred embodiment subject of this disclosure illustrates a barrier comprised of two tubular arms 144 145. However other configurations may be used and are included within the scope of the invention.

The barrier component is elevated from the stored position to the deployed position by movement of the swing arm, powered by energy from the gas generator pushing the piston within the cylinder and extending the piston rod attached to one end of the swing arm.

The first end 132 of the swing arm 130 is hingeably attached to a first end of the piston rod 150. The second end (not shown) of the piston rod is attached to a piston head (not shown) contained within the annulus of the cylinder 155. The operation of the piston within the cylinder will be readily understood by persons skilled in the art. Simply stated, the piston head can move longitudinally along the axis of the cylinder annulus. The back end 156 of the cylinder is closed. The front end 157 of the cylinder is partially closed with the piston rod extending though the end allowing the piston rod to move along the longitudinal axis of the cylinder annulus in response to movement of the piston head. The cylinder may also be attached to a subcomponent 192 of the barrier housing 110. (See FIG. 3.)

The system may also included anchors attachable to the housing to hold the barrier system in a removable but fixed position on the earth or mounting surface. The anchors can be of various types suitable to hold the barrier in a fixed position upon impact with a load, e.g. an explosive laden vehicle, and to preferably at least partially transfer the load to the ground. The anchors can be plates buried into the ground and attached to the housing by chains or tethers. The anchors can be pins or spikes driven into the ground surface through holes (not shown) in the housing bottom plate 111. (See FIG. 3.)

The system can also be embedded at least partially within the ground. For example, the housing can be partially dug into the ground surface. This can be in conjunction with or in lieu of separate anchors.

The barrier system may utilize the weight of the object, i.e., vehicle, to anchor the system into position and to transfer the load to the ground. (See FIGS. 10 and 10A of the parent application incorporated by reference herein.)

The housing may serve as part of the reinforcing structure of the barrier system. In the preferred embodiment, the housing 110 contains two primary support beams 120 each having a first and second end. The support beams comprise the side of the housing and have a length L and height H.

Figure 6A:
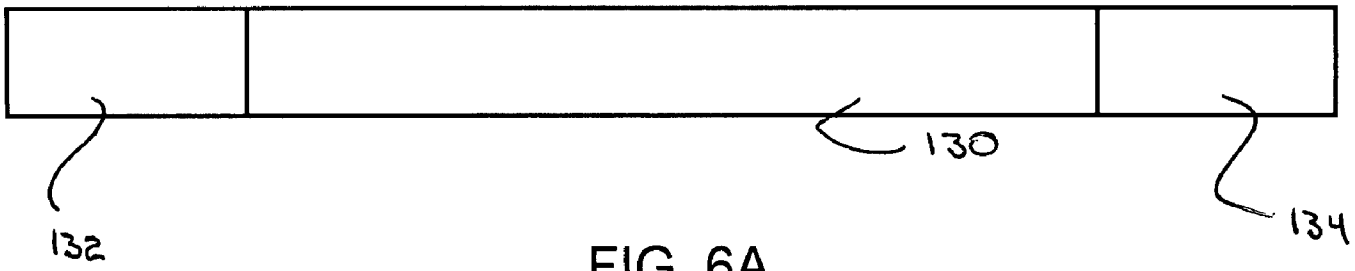
FIG. 6A is a top view of a swing arm.
Figure 6B:
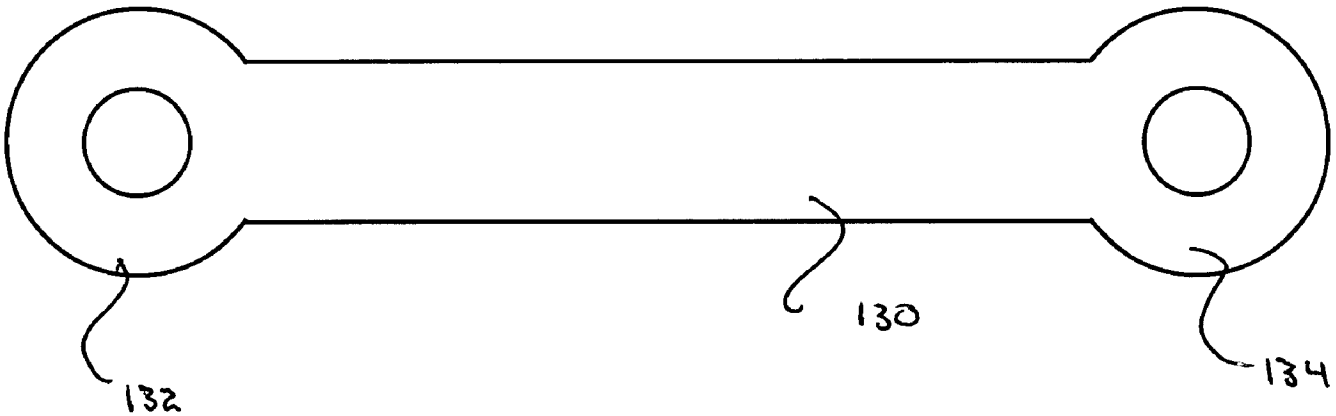
FIG. 6B illustrates a side view of the swing arm, including the hinge subcomponents connecting to the swing arm hinge component of the barrier and connecting to the piston rod.

The swing arm 130 may be comprised of one, two or more separate arms each having a first 132 and second 134 end. (See FIGS. 6A & 6B.) The second end of the swing arm holds the barrier component. The first end of the swing arm is hingeably attached to the piston rod/cylinder component.

When deployed, the barrier, attached to the second end 134 of the swing arm 130 by the swing arm hinge connector 143, is raised upward with the swing arm first end 132 pivoting on the hinge attachment to the piston rod 150 component.

The deployment of the barrier is powered by the activation of the gas generator solid propellant. The gas generator 154 is shown within the cylinder 155 in FIGS. 7A and 7B. The expanding gas created by ignition of the gas generator within the cylinder 155 pushes the piston and piston rod 150 backward as shown by vector arrow 970. The generator may be a steel canister (nominally 1–2" diameter and 3–4" long). Inside this canister is a small amount of propellant. The propellant may be ball shot, i.e., basically the same powder found in a shot gun shell. Other propellants are known and may also be used. For example, the gas may be generated by the pyrolytic reaction of sodium azide ($NaN_3$) with potassium nitrate ($KNO_3$).

The propellant may be activated by ignition by a squib or igniter. The squib may look basically like a paper match. It may be coated with an accelerator/propellant that ignites very hot and fast. If one is set off it sounds like a firecracker. The squib may be ignited by the application of electrical current. The speed at which it ignites is based on the amperage applied. Squibs are typically identified as "5 amp all fire." What this means is that if you provide a 5 amp current to the squib, it will fire at its highest rated speed. If the amperage is lower, it takes slightly longer to fire but it still ignites in a very short time. Typically, if you go below 1 amp, the squib will not fire (this is for safety and stray currents created by static etc.). The amount of propellant in the gas generator can be varied depending on what you want to move with the energy. In the embodiment described in this disclosure nominally 70 grams may be used. The gas generator may have a nozzle that releases the pyrolysis gases at a controlled rate.

Figure 7A:
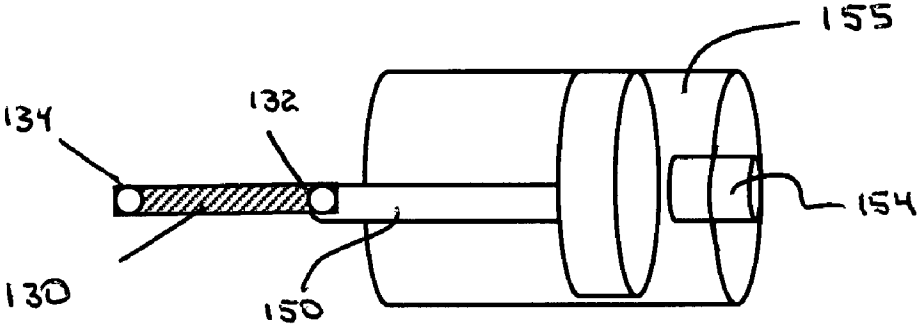
FIGS. 7A and 7B illustrate the movement of the piston and piston rod in response to the activation of the gas generator within the cylinder.
Figure 7B:
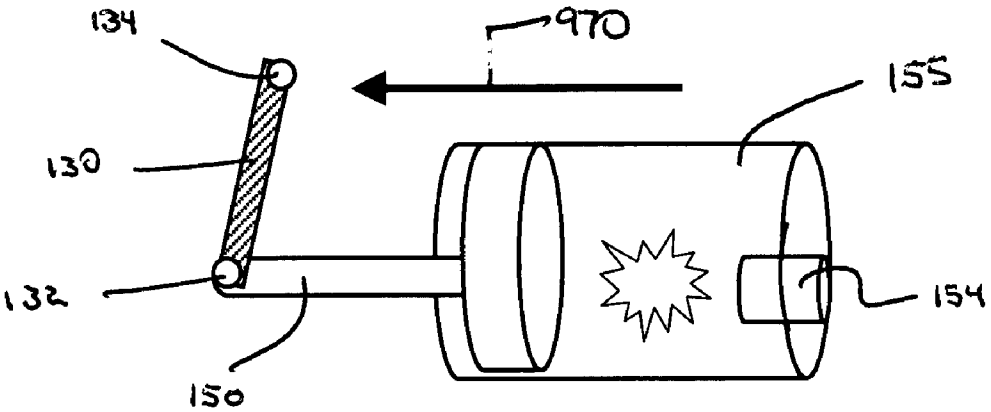

Referencing again FIGS. 7A and 7B, the gas generator 154 is within the enclosed cylinder 155 also containing a piston and attached piston rod 150. The first end of the piston rod extends from the cylinder and is hingeably attached to the first end 132 of the swing arm 130. The second end of the piston rod is attached to the piston within the cylinder. The solid propellant is ignited by the igniter or squib component of the gas generator. Pyrolysis gases are generated from the solid propellant. The expanding gases drive the piston in an outward direction from within the cylinder (vector arrow 970). The resulting movement of the attached piston rod causes the swing arms, hingeably attached to the first end of the piston rod, to be pushed upward. The swing arm, thereby, in turn, elevates the barrier (not shown).

This action causes the second end of the swing arm to pivot on the hinged attachment to the barrier, thereby changing the swing arm's orientation to the bottom of the housing component. Prior to deployment by the ignition of the solid propellant, the swing arm had been substantially co-planer or parallel to the bottom of the housing. (See FIG. 7A.) As a result of the movement of the piston and piston rod pushing the first end of the swing arm laterally along the length L of the housing (reference FIG. 4B), the second end of the swing arm, being attached to the swing arm hinge connector, raises the barrier and the swing arm now forms an acute angle to the bottom of the housing. It will be appreciated that the movement of the piston rod is substantially co-planer to the bottom of the housing component.

The upward movement of the swing arm second end is controlled in part by the length of movement to the piston rod. The piston rod movement can be controlled by limiting the movement of the piston in response to the expanding pyrolsis gases. The upward movement of the swing arm second end (and thereby the elevation of the barrier) can also be controlled by separate tether 160 components. (See FIG. 1) The tethers also have a first end and a second end. In the preferred embodiment, the first end can of the tether is attached to the barrier end 141 of the barrier 140 component. The second end of the tether may be attached to the support beams 120 of the housing (now serving as a structural component of the barrier system). It will be appreciated that the length of the tether can control the elevation of the barrier. The tether length may be adjustable.

The expanding gases drive the piston and piston rod within the cylinder, which raises the barrier into its deployed position. In the preferred embodiment, once raised, there is a lock which holds the barrier in position. The locks are basically mechanical where it "snaps" into position and holds the barrier (not shown).

Referring to FIGS. 4A and 4B, the support beams 120 (plates of steel) form the longitudinal members or sides of the overall housing structure. The support beams are connected by the bottom plate 111 and cross members end pieces 112, 113, that in essence form the base of the barrier in a rectangular shape having dimensions L, W and H. In the preferred embodiment reinforcement 114 may be placed in the corners. The height H of the longitudinal support beam also facilitates the storage of the barrier component within the housing 110.

In the preferred embodiment, anchors (not shown) are attached by chains to the longitudinal support beams at the corners (not shown). The anchors may be plates (square) that are buried about 8 inches into the ground. Earth covers the plates and the areas of the plates are covered and serve as retainers in the ground.

The barrier end 141 (the member that impacts the vehicle) raises to a position or height which may be controlled by the tether 160. The tethers may be a structural steel or high strength ropes. For the test, ropes were used that were rated to carry loads in excess of 400,000 lbs. The tether ties the barrier to the structure and helps hold the barrier in position. This is a feature that makes the barrier portable. The arms 144, 145 of the barrier may be substantially hollow tubes that will bear the load (and transfer it to the ground) along the longitudinal length of the tube. The tubes may be reinforced by the barrier end subcomponent 141, the swing arm hinge connector 143 and the housing end plate 112. Note that the aft end 112 of the support beam 120 and housing 110 is tapered (illustrated to be a 60° angle). This is intended to drive the structure into the ground and prevent the threat vehicle from pushing over the barrier. In other words, a barrier that can stop a vehicle is preferably designed and installed to utilize the earth to take the impacting load. This feature plus the configuration of the overall structure uses this same concept in maintaining its lightweight and portability.

Note for the tests conducted, the squib activation control was hard wired. This means that an electrical signal (e.g. 5 amps) was sent to the gas generator via a wire. The source of the power was a battery. Once power is sent, the gas generator activates via the squib. It will be appreciated that the signal can transmitted by RF signal and be activated by numerous types of sensors. In other words, the sensor may detect a threat; send the signal via RF or other means to the control box. This small amount of energy would be used to activate a switch that would send the current to the squib. The power for the squib would be part of the barrier system and could be a battery or capacitor. The energy required to set off the squib can be adjustable to prevent false signal from setting off the activation switch.

The barrier component 140 and cylinder/piston component 155 containing the gas generator may be attached to the housing end cross member plate 112. The barrier 140 attaches to the back end plate 112 through a structural tube or tube (illustrated as two tubes 144, 145). The piston/cylinder component 155 is attached 192 to one end of the end plate and extends via the piston rod 150 to the pivot connection with the first end 132 of the swing arm. The barrier (which rises into position upon deployment) is connected to the pivot connection of the second end 134 of the swing arm 130 with the swing arm hinge connector 143. The barrier preferably rotates on a hinge connection with the back end plate 112. The hinge is actually a tubular or rod shape where it consists of a cylinder or rod that penetrates the side plates 120. The piston when activated pushes the swing arm that raises the barrier into its position.

The piston is a simple device that reacts to the pressure provided by the pyrolysis gases generated from the propellant.

The gas generator is shown in FIGS. 7A and 7B. The generator is basically a steel canister (nominally 1–2" diameter and 3–4" long). Inside this canister can be a small amount of propellant (e.g. what may be called ball shot which is basically the same powder used in a shot gun shell). The squib ignites through the application of electrical current. The speed at which it ignites is based on the amperage applied. The amount of propellant in the gas generator can be varied depending on what you want to move with the energy. For test applications, approximately 70 grams were used. The gas generator may have a nozzle that releases the pyrolysis gases at a controlled rate.

As stated prior, very high strength ropes are preferably used as a tether. These allow for flexibility in the design and permit various heights and strengths. The tether may be replaced by a permanent fixed or flexible height, structural member in either the form of a cable, rod or other structural material. The tether is anchored to the barrier structure and the entire barrier system, when deployed after activation, acts as a single structure to resist the forces impacting it and transfer the load to the ground.

Figure 8:
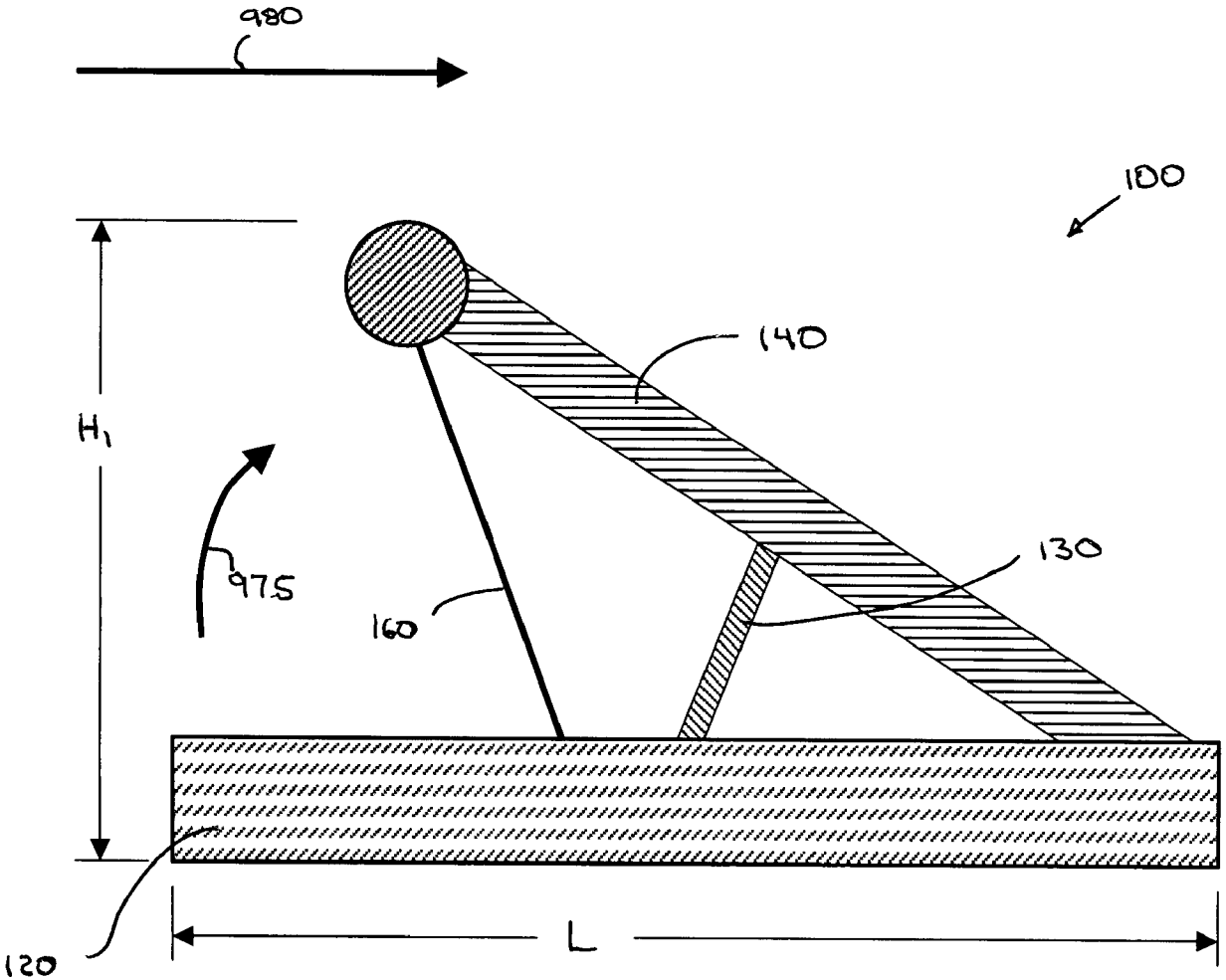
FIG. 8 illustrates a side view of the deployed barrier system and the relationship between the deployed height and the length.

FIG. 8 illustrates a side view of the deployed barrier system 100. The direction of movement of the barrier component in deployment is illustrated by the vector arrow 975. The direction of the load is illustrated by the vector arrow 980. Also illustrated is the position of the tether 160, the structural support/housing sides 120, swing arm 130, and barrier component 140. Note that in the preferred embodiment, the length of the system L is greater than the deployed height $H_1$ of the barrier. This facilitates the stability of the system upon load impact and facilitates the transfer of load to the ground. The system is likely to become wedged between the vehicle and the ground with a significant portion or vector the load directed into the ground.

In the preferred embodiment, the deployed barrier forms an acute angle relative to the plane of the ground surface and oriented to the direction of the load. The acute angle is preferablely less than 45°

This specification is to be construed as illustrative only and is for the purpose of teaching those skilled in the art the manner of carrying out the invention. It is to be understood that the forms of the invention herein shown and describe are to be taken as the presently preferred embodiments. As already stated, various changes may be made in the shape, size and arrangement of components or adjustments made in the steps of the method without departing from the scope of this invention. For example, equivalent elements may be substituted for those illustrated and described herein and certain features of the invention may be utilized independently of the use of other features, all as would be apparent to one skilled in the art after having the benefit of this description of the invention.

Further modifications and alternative embodiments of this invention will be apparent to those skilled in the art in view of this specification and are included within the scope of the invention claimed.

What we claim is:

1. A barrier system comprising:

a) a housing component;

b) at least one first cylinder having a first end and a second end wherein the first end is closed and attached to the housing;

c) at least one piston and piston rod located at least partially within the first cylinder and moveable in relation to the first cylinder so that the piston rod can be extended past the second end of the first cylinder;

d) a gas generator located at least partially within the first cylinder to move the piston and piston rod;

e) a swing arm component having a first end and second end where the first end is connected to the piston rod and the second end is connected to a barrier component; and f) a barrier component comprising at least one arm.

2. The barrier system of claim 1 wherein the barrier has a first end and a second end and one end is hingeably attached to the housing.

3. The barrier system of claim 1 wherein the housing further comprises a structural support.

4. The barrier system of claim 1 further comprising tethers.

5. The barrier system of claim 1 further comprising anchors.

6. The barrier system of claim 1 further comprising locking mechanism.

7. The barrier system of claim 1 further comprising a sensor component.

8. The barrier system of claim 1 further comprising a power source.

* * * * *